US009329550B2

(12) United States Patent
Tanaka

(10) Patent No.: US 9,329,550 B2
(45) Date of Patent: May 3, 2016

(54) IMAGE FORMING APPARATUS

(71) Applicant: KYOCERA Document Solutions Inc., Osaka-shi (JP)

(72) Inventor: Yoko Tanaka, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/722,966

(22) Filed: May 27, 2015

(65) Prior Publication Data

US 2015/0346666 A1 Dec. 3, 2015

(30) Foreign Application Priority Data

May 30, 2014 (JP) ..... 2014-112612

(51) Int. Cl.
*G03G 15/00* (2006.01)

(52) U.S. Cl.
CPC ..... *G03G 15/553* (2013.01)

(58) Field of Classification Search
CPC G03G 15/5016; G03G 15/502; G03G 15/553
See application file for complete search history.

(56) References Cited

U.S. PATENT DOCUMENTS

| | | | | |
|---|---|---|---|---|
| 7,728,819 | B2 | 6/2010 | Inokawa | |
| 2007/0104496 | A1* | 5/2007 | Penke et al. | G03G 15/5016 399/16 |
| 2007/0146334 | A1 | 6/2007 | Inokawa | |
| 2009/0125841 | A1* | 5/2009 | Yamashita | G03G 15/502 715/810 |
| 2014/0184545 | A1* | 7/2014 | Tanaka | G03G 15/5016 345/173 |

FOREIGN PATENT DOCUMENTS

JP 2005-149197 A 6/2005

* cited by examiner

*Primary Examiner* — Gregory H Curran
(74) *Attorney, Agent, or Firm* — Studebaker & Brackett PC

(57) ABSTRACT

An image forming apparatus includes an operation panel including a display section that displays buttons, a touch panel section, and piezoelectric elements. The image forming apparatus also includes a vibration control section and a determination section. The vibration control section outputs a drive signal to the piezoelectric elements that causes vibration of the piezoelectric elements and the touch panel section. The determination section determines for each maintenance target whether the maintenance target is an inspection target that preferably undergoes maintenance within a preset period of a current time. Upon operation of a button while no inspection target is present, the vibration control section causes the touch panel and the piezoelectric elements to vibrate under a normal vibration condition. Upon operation of a preset button while an inspection target is present, the vibration control section causes vibration of the touch panel section and the piezoelectric elements under a different vibration condition.

12 Claims, 10 Drawing Sheets

IMAGE FORMING APPARATUS

INCORPORATION BY REFERENCE

The present application claims priority under 35 U.S.C. §119 to Japanese Patent. Application No. 2014-112612, filed May 30, 2014. The contents of this application are incorporated herein by reference in their entirety.

BACKGROUND

The present disclosure relates to image forming apparatuses that include a display section, a touch panel section, and piezoelectric elements that causes vibration of the touch panel section.

In recent years there have been examples of piezoelectric elements being provided in input devices for receiving operations and input (for example, portable information terminals) that include a display section and a touch panel section that are overlapped on one another. When an input operation is performed by touching a position at which a button is displayed, voltage is applied to the piezoelectric elements causing displacement (deformation) thereof. Vibration based on displacement of the piezoelectric elements stimulates a user's sense of touch. Thus, the piezoelectric elements can be used to provide the user with a clicking sensation similar to when an operation is performed on a hard key.

The following explains a disclosed example of such a technique. Specifically, an input device has been disclosed including a panel displacement section (piezoelectric actuator) that detects whether or not the surface of a panel is pressed or touched, and upon detecting a press or touch, generates a signal from the time of the press or touch. After the panel displacement section confirms the press or touch, the panel displacement section generates a signal for causing a higher vibration amplitude than the signal generated from the time of the press or touch, and causes displacement of the panel in accordance with the generated signal. According to the above configuration, in addition to a clicking sensation, a user can be provided with a stroke sensation similar to when pressing a switch button by changing the vibration amplitude part way through.

SUMMARY

An image forming apparatus according to the present disclosure includes an operation panel that includes a display section, a touch panel section, a plurality of piezoelectric elements, and a panel control section. The display section displays buttons on a screen for receiving operations from a user. The touch panel section receives an operation from the user by detecting a position at which a touch is performed with respect to the display section. The piezoelectric elements are arranged in contact with the touch panel section. The panel control section detects content of the operation from the user based on output of the touch panel section. The image forming apparatus further includes a vibration control section, one or more maintenance targets, and a determination section. The vibration control section outputs a drive signal to the piezoelectric elements that causes vibration of the piezoelectric elements and the touch panel section. The maintenance targets are each a target for replacement or replenishment and each have a maintenance time that is preset in accordance with a type thereof. The determination section determines for each of the maintenance targets based on the maintenance time thereof, whether or not the maintenance target is an inspection target that preferably undergoes maintenance within a preset period of a current time. In a situation in which a button displayed by the display section is operated while an inspection target is not present, the vibration control section causes the touch panel and the piezoelectric elements to vibrate under a normal vibration condition by outputting a preset normal drive signal to the piezoelectric elements. In a situation in which a preset button displayed by the display section is operated while an inspection target is present, the vibration control section causes the touch panel and the piezoelectric elements to vibrate under a different vibration condition to the normal vibration condition by outputting a notification drive signal to the piezoelectric elements that is different to the normal drive signal.

DETAILED DESCRIPTION

The following explains an embodiment of the present disclosure with reference to FIGS. 1-12. In the following explanation, a multifunction peripheral 100 is used as an example. Note that elements of the present embodiment such as configuration and positioning are merely examples provided to facilitate explanation and do not in any way limit the scope of the present disclosure. The multifunction peripheral 100 is equivalent to the "image forming apparatus".

Overall Configuration of Multifunction Peripheral 100

Figure 1:
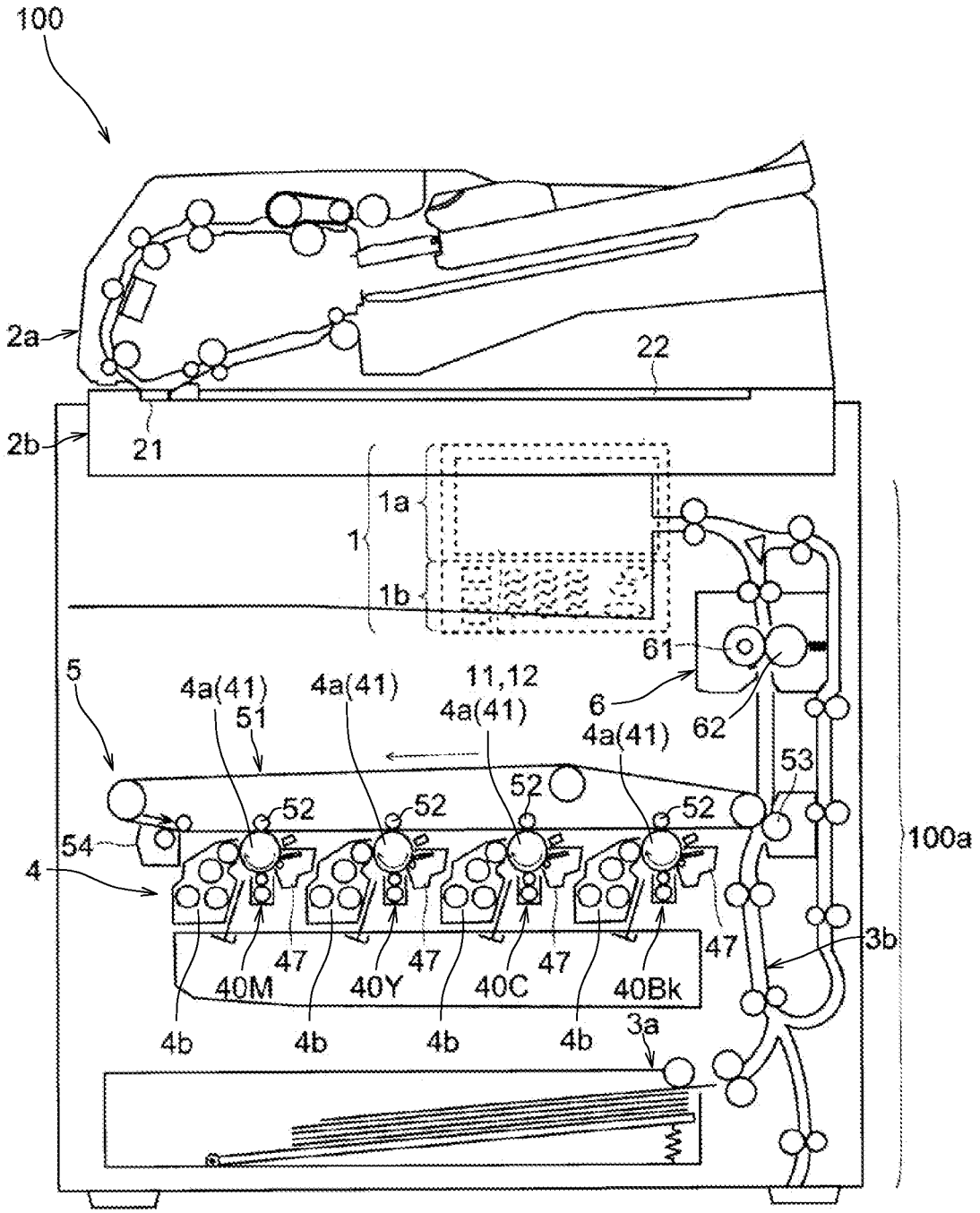
FIG. 1 illustrates an example of a multifunction peripheral.

The following explains the multifunction peripheral 100 according to the embodiment with reference to FIG. 1. FIG. 1 illustrates an example of the multifunction peripheral 100.

As illustrated in FIG. 1, the multifunction peripheral 100 includes an operation panel 1, a document conveyance section 2*a*, and an image scanning section 2*b*. The document conveyance section 2*a* conveys a document toward contact glass 21 for conveyed scanning. The image scanning section 2*b* scans an image formed on the document as the document passes above the contact glass 21 for conveyed scanning and thereby generates image data for the document. The image scanning section 2*b* also scans a document loaded onto contact glass 22 for loaded scanning and thereby generates image data for the document. The multifunction peripheral 100 also includes a printing section 100*a*. The printing section 100*a* includes a paper feed section 3*a*, a conveyance section 3*b*, an image forming section 4, a transfer unit 5, and a fixing unit 6.

The paper feed section 3*a* supplies paper and feeds the paper toward the conveyance section 3*b*. The conveyance section 3*b* conveys the paper and externally ejects the paper once printing has been performed thereon. The image forming section 4 forms a toner image based on image data. The image forming section 4 includes a black image forming unit 40Bk, a cyan image forming unit 40C, a yellow image forming unit 40Y, and a magenta image forming unit 40M. The image forming units 40 are explained in detail further below. The transfer unit 5 receives toner images formed by the image formation units 40 by primary transfer and transfers the toner images onto paper by secondary transfer. The fixing unit 6 fixes a toner image that has been transferred onto paper by applying heat and pressure.

When an execution instruction for a copying job is performed on the operation panel 1, the printing section 100*a* performs printing on paper based on image data acquired through scanning of a document by the image scanning section 2*b* (i.e., performs a copy function). The printing section 100*a* also performs printing on paper of an image corresponding to printing data received by a communication section 74 (i.e., performs a print function).

Operation Panel 1

Figure 2:
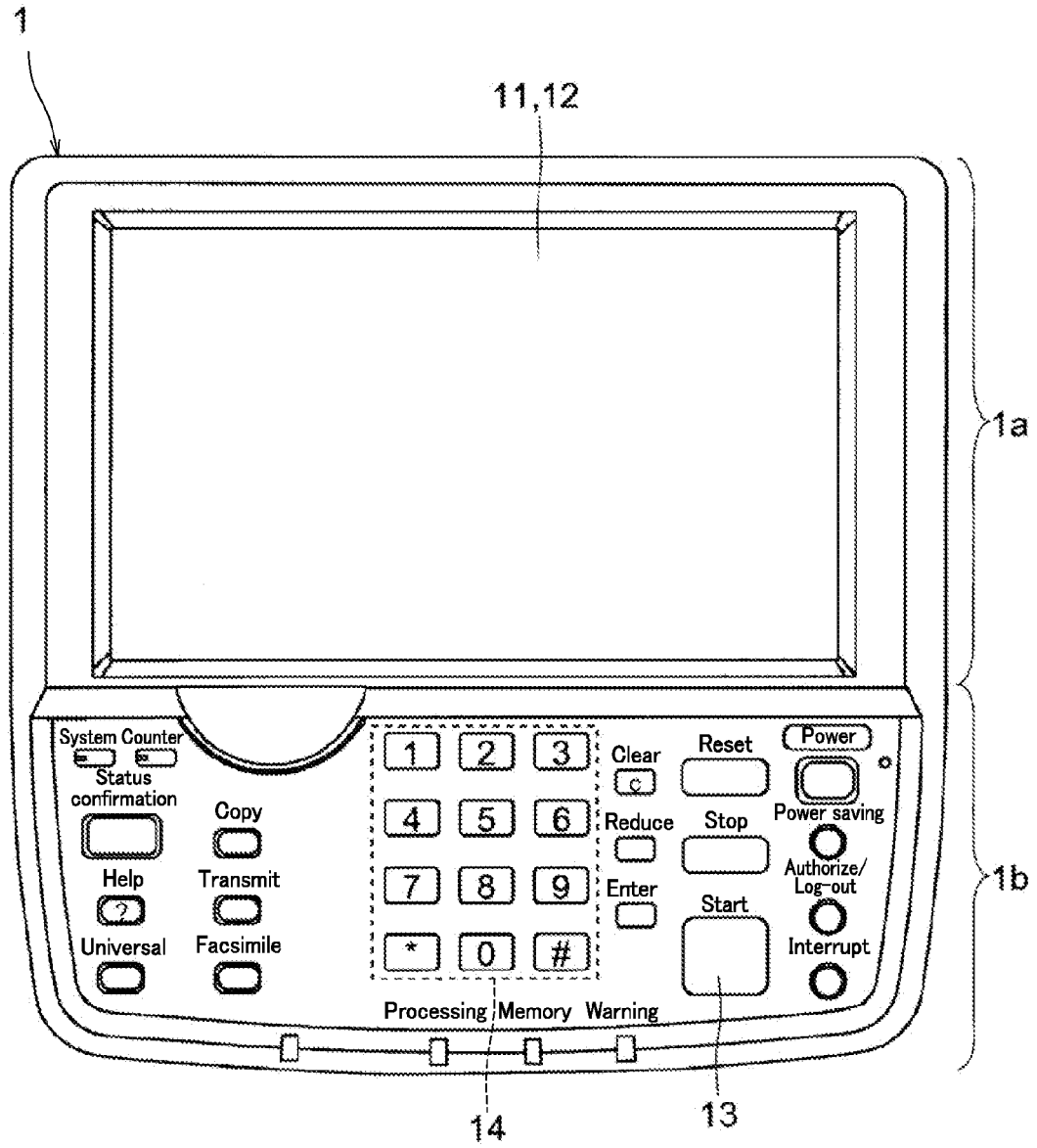
FIG. 2 illustrates an example of an operation panel.

The following explains an example of the operation panel 1 according to the embodiment with reference to FIGS. 1 and 2. FIG. 2 illustrates an example of the operation panel 1.

As illustrated in FIG. 1, the operation panel 1 is located on an upper part of a front surface of the multifunction peripheral 100. The operation panel 1 includes a display panel section 1*a* that includes a display section 11 and a touch panel section 12. The display section 11 provides settings and operation instructions for the multifunction peripheral 100 to a user, displays menus and buttons for operating the multifunction peripheral 100, and also for example displays messages indicating the status of the multifunction peripheral 100. The display section 11 is for example equipped with a liquid-crystal display panel or an organic EL display panel.

The touch panel section 12 is located at an upper surface side of the display section 11. The touch panel section 12 detects a position (touch position coordinates) of the display section 11 with respect to which a user performs a touch and thereby receives an operation from the user. Note that the touch panel section 12 may operate by any of various methods such as an electrostatic capacitance method, a resistive film method, a surface acoustic wave method, or an infra-red method.

The operation panel 1 also includes a hard key section 1*b* that includes hard keys such as a start key 13 for instructing commencement of a job such as copying and a numeric keypad 14 for inputting numbers. As explained above, the operation panel 1 includes the touch panel section 12 and the hard key section 1*b*, and is a display input device through which the user can make various settings, mode selections, and the like with respect to each function of the multifunction peripheral 100.

Configuration of Multifunction Peripheral 100

Figure 3:
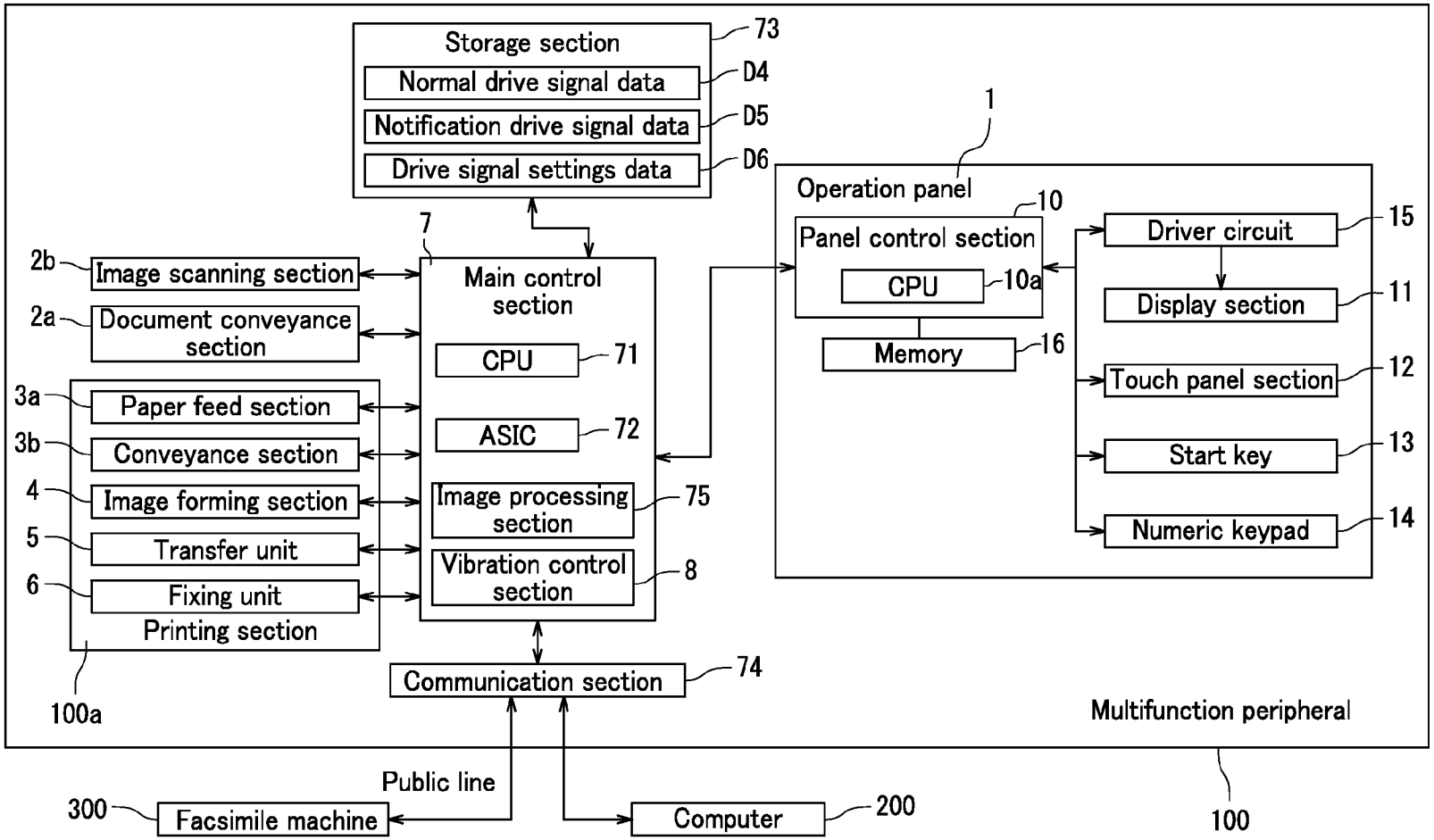
FIG. 3 illustrates an example of configuration of a multifunction peripheral.

The following explains an example of hardware configuration of the multifunction peripheral 100 according to the embodiment with reference to FIG. 3. FIG. 3 illustrates an example of configuration of the multifunction peripheral 100.

The multifunction peripheral 100 includes a main control section 7 in a main body thereof. The main control section 7 is equivalent to the "determination section". The main control section 7 is connected to components such as the operation panel 1, the document conveyance section 2*a*, the image scanning section 2*b*, and the printing section 100*a* (the paper feed section 3*a*, the conveyance section 3*b*, the image forming section 4, the transfer unit 5, and the fixing unit 6) and performs control of the aforementioned components.

The main control section 7 for example includes a CPU 71 and an ASIC 72 that is a dedicated circuit for performing processing in the multifunction peripheral 100. The CPU 71 controls each component of the multifunction peripheral 100 by performing calculation and processing based on a control program and control data stored in a storage section 73. Note that the main control section 7 may be partitioned into a plurality of sections for different functions such as an overall control section, a primary control section that performs image processing, and an engine control section that controls the printing section 100*a*.

The storage section 73 in connected to the main control section 7 in a communicable manner. The storage section 73 includes storage devices such as a ROM, a RAM, and a HDD. The storage section 73 stores a control program, control data, and settings data for the multifunction peripheral 100 and also stores various types of data such image data for a document that is scanned by the image scanning section 2*b*. The main control section 7 also includes an image processing section 75 that for example performs image processing with respect to image data acquired through scanning of a document by the image scanning section 2*b* and image data input to the multifunction peripheral 100 via the communication section 74. Image data that is processed by the image processing section 75 is used for printing or transmission.

The main control section 7 is connected to a communication interface section (referred to below as communication section 74) that includes various connectors, sockets, and a facsimile modem. The communication section 74 receives data to be printed or transmitted from a facsimile machine 300 or an external computer 200 that is connected to the communication section 74 for example via a network and a public line. The computer 200 is for example a personal computer or a server. Image data acquired by the image scanning section 2*b* can be transmitted to the computer 200 or to the facsimile machine 300 (i.e., performing a scan function and a facsimile function).

The main control section 7 also includes a vibration control section 8 that controls piezoelectric elements 9 arranged in the operation panel 1 that cause vibration of the touch panel section 12. The vibration control section 8 includes a piezoelectric element control circuit that detects output of the piezoelectric elements 9. The vibration control section 8 applies voltage to the piezoelectric elements 9. Detailed explanation of the vibration control section 8 is provided further below.

The content of settings made through the operation panel 1 by the user with respect to a job is notified to the main control section 7. The main control section 7 controls the multifunction peripheral 100 to execute a job, such as copying, in accordance with the settings made by the user. The operation panel 1 includes a panel control section 10, a driver circuit 15, a memory 16, the display section 11, and the touch panel section 12. The panel control section 10 for example includes a CPU 10*a* and circuitry such as an IC. The panel control section 10 controls display by the display section 11 by providing an instruction to the driver circuit 15 which directly controls display by the display section 11. Further, the panel control section 10 detects coordinates of a position touched by a user based on output of the touch panel section 12. The memory 16 stores data therein that indicates correspondence between the output of the touch panel section 12 and the coordinates of the position that is touched. The panel control section 10 detects a button on the screen that has been selected by comparing the coordinates of the touched position and image data of a displayed screen image. In order words, the panel control section 10 detects content of an operation by the user based on output of the touch panel section 12 and display of the display section 11. Through the above configuration, the user can perform various settings and operation instructions through the operation panel 1 with respect to each function of the multifunction peripheral 100 such as a copy function and a facsimile transmission function.

Display Panel Section 1*a*

Figure 4:
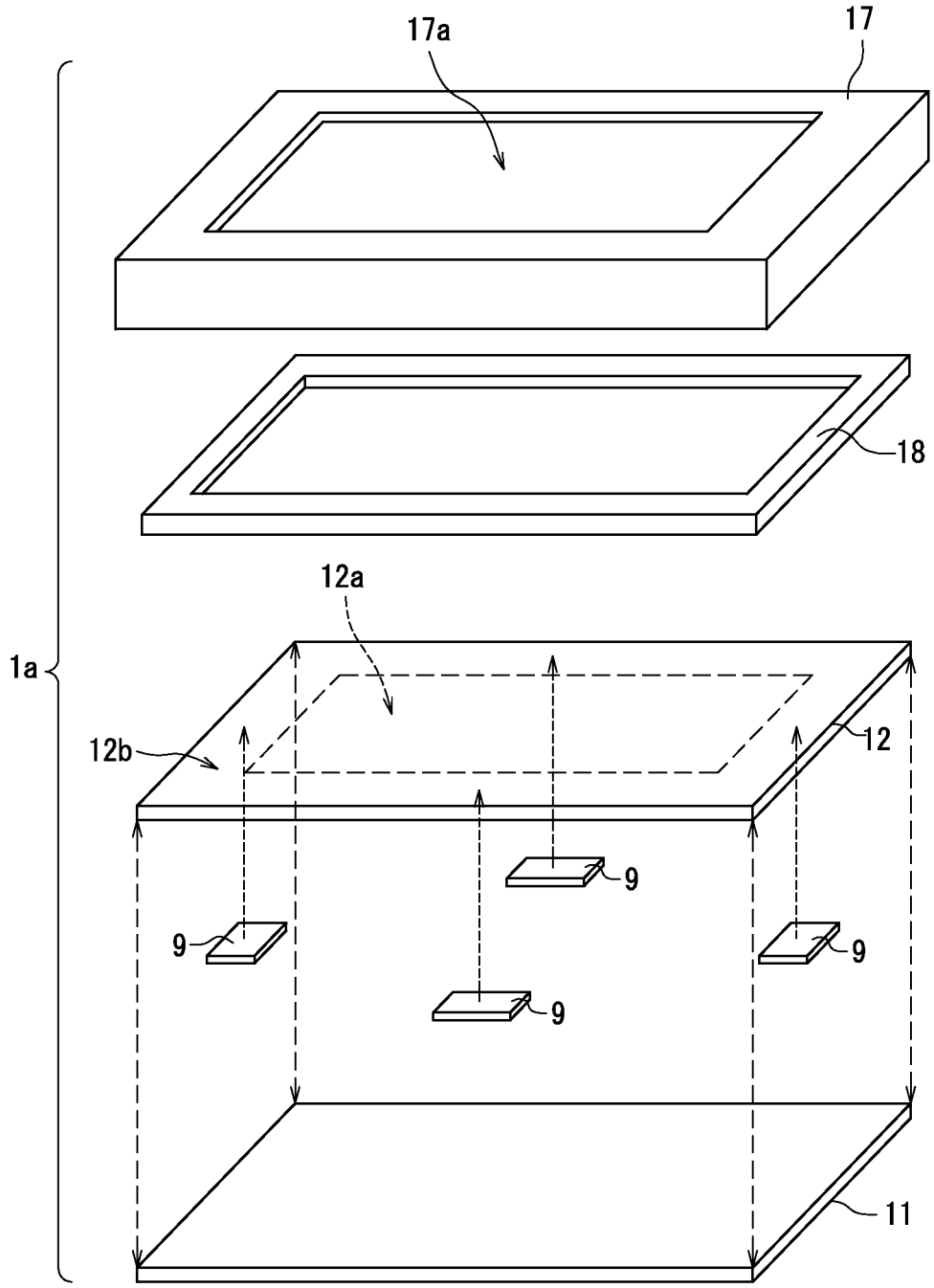
FIG. 4 illustrates an example of configuration of a display panel section.

The following explains the display panel section 1*a* including the display section 11 and the touch panel section 12 with reference to FIG. 4. FIG. 4 illustrates an example of configuration of the display panel section 1*a*. Note that the hard key section 1*b* of the operation panel 1 is omitted in FIG. 4.

As illustrated in FIG. 4, the display panel section 1*a* also includes the plurality of piezoelectric elements 9 that cause vibration of the touch panel section 12. The piezoelectric elements 9 for example each have a rectangular shape. The piezoelectric elements 9 are each attached to a rear surface side of the touch panel section 12 such as to be in contact with the touch panel section 12. Each of the piezoelectric elements 9 is made from a material such as lead zirconate titanate that exhibits a piezoelectric effect and for example has a multilayer structure.

The display section 11 is located at the rear surface side of the touch panel section 12 such that there is a specific gap between the display section 11 and the touch panel section 12. An image displayed by the display section 11 is transmitted through the touch panel section 12. The touch panel section 12 is for example a transparent plastic or glass plate. The piezoelectric elements 9 are each attached to a surface on a lower side (side corresponding to the display section 11) of the touch panel section 12. Note that alternatively the piezoelectric elements 9 may each be attached to a surface on an upper side of the touch panel section 12. The piezoelectric elements 9 are for example attached to the touch panel section 12 by a bonding agent or double sided tape.

The display panel section 1*a* also includes a cosmetic case 17 that has an opening 17*a* therein. The opening 17*a* has a rectangular shape through which a rectangular region of the touch panel section 12 corresponding to the opening 17*a* is exposed externally. The exposed region forms a touchable region 12*a* that can be viewed and touched by the user. Thus, a portion of the display section 11 that can viewed by the user is the region corresponding to the opening 17*a*. The user performs a setting operation of a desired function and settings by touching a display position that for example corresponds to a button displayed on the display section 11 and projected through the touchable region 12*a*. On the other hand, the piezoelectric elements 9 are attached to a portion of the touch panel section 12 in a peripheral region 12*b* that is hidden by the cosmetic case 17 and thus cannot be viewed or touched by the user.

The cosmetic case 17 covers the touch panel section 12, the piezoelectric elements 9, and the display section 11. A sealant 18 is provided between the cosmetic case 17 and the touch panel section 12 in order to prevent penetration of dust and dirt.

Vibration of Piezoelectric Elements 9 and Touch Panel Section 12

Figure 5:
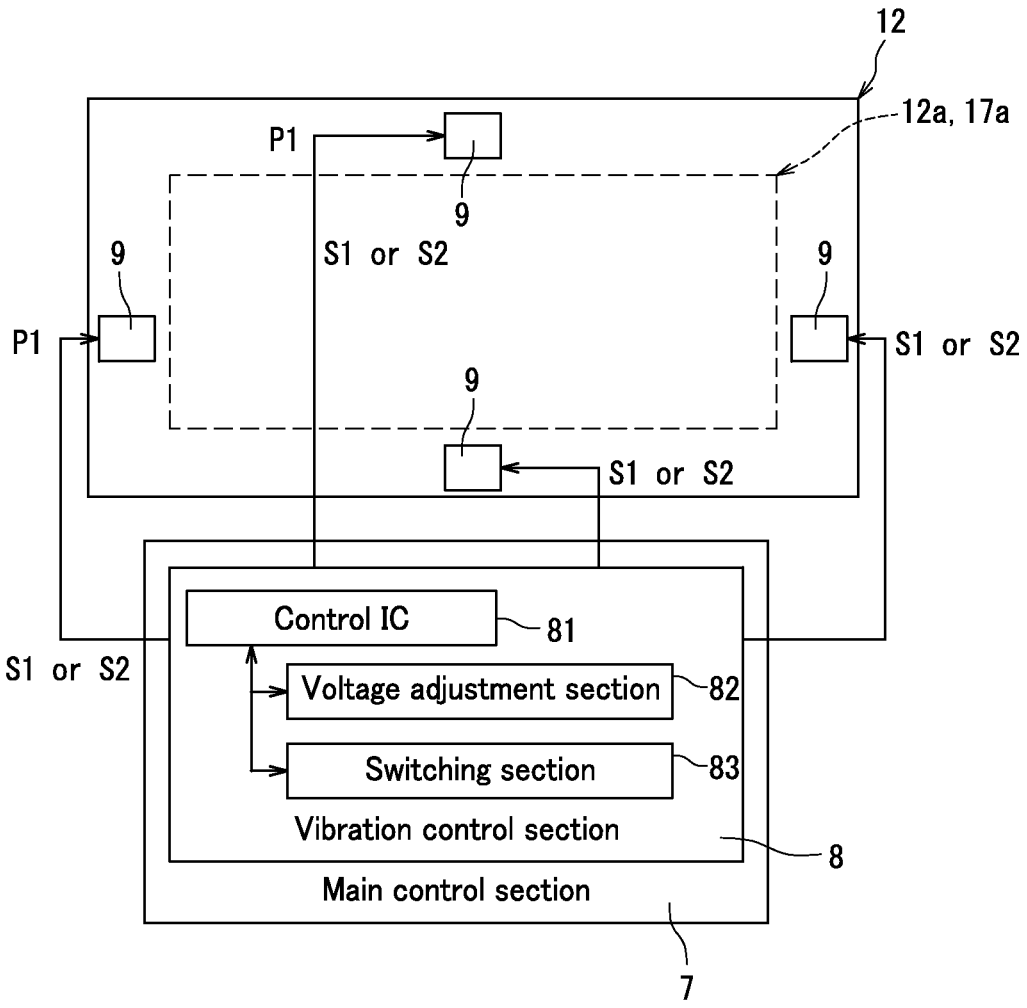
FIG. 5 illustrates an example of a configuration for causing vibration of piezoelectric elements.

The following explains vibration of the piezoelectric elements 9 and the touch panel section 12 in the operation panel 1 according to the embodiment with reference to FIG. 5. FIG. 5 illustrates an example of a configuration for causing vibration of each of the piezoelectric elements 9.

As illustrated in FIG. 5, in the present embodiment the piezoelectric elements 9 are arranged such that one piezoelectric element 9 is located on each edge—upper, lower, left, and right edges—of the touch panel section 12. Also, each of the piezoelectric elements 9 is positioned a preset distance inwards from the end of the corresponding edge of the touch panel section 12 such that a center thereof overlaps with a straight line at 90° to the edge that passes through a central position of the edge. Note that arrangement of the piezoelectric elements 9 is not limited to the arrangement described above and the piezoelectric elements 9 may alternatively be arranged in a different form.

The vibration control section 8 includes a control circuit (control IC) 81, a voltage adjustment section 82, and a switching section 83. The control circuit 81 performs ON and OFF control of voltage application to each of the piezoelectric elements 9. The voltage adjustment section 82 is a circuit that generates direct current voltage used as a drive signal output to the piezoelectric elements 9 and can adjust the magnitude of the voltage. The switching section 83 is a switching element for switching voltage application to each of the piezoelectric elements 9 between ON and OFF. The switching section 83 switches voltage application to each of the piezoelectric elements 9 between ON and OFF based on an instruction from the control circuit 81. As a result of the switching, a pulse signal is output to each of the piezoelectric elements 9.

In a situation in which a button is operated while the main control section 7 determines that no maintenance target having a replacement or replenishment time within a preset period is present, the control circuit 81 outputs a normal drive signal S1 to each of the piezoelectric elements 9. More specifically, when outputting the normal drive signal S1, the control circuit 81 causes the voltage adjustment section 82 to generate a direct current voltage of a preset magnitude. The voltage adjustment section 82 includes a converter that outputs a voltage in accordance with an instruction from the control circuit 81. The control circuit 81 causes the switching section 83 to perform switching of voltage application to each of the piezoelectric elements 9 between ON and OFF at a preset frequency during a preset input period (for example, approximately 0.5 seconds). Input of the normal drive signal S1 causes deformation of the piezoelectric elements 9 and thus causes the piezoelectric elements 9 and the touch panel section 12 in contact therewith to vibrate under normal vibration conditions (normal vibration amplitude, normal vibration frequency, and normal vibration time). The aforementioned vibration can be used to provide the user with a sensation similar to performing an operation such a click.

In the operation panel 1 according to the present embodiment, the vibration conditions of the piezoelectric elements 9 and the touch panel section 12 can be adjusted. In other words, the vibration amplitude, vibration frequency, and vibration time of the piezoelectric elements 9 and the touch panel section 12 can be changed from the normal vibration amplitude, the normal vibration frequency, and the normal vibration time explained above. In a situation in which a button is operated while the main control section 7 determines that a maintenance target which has almost reached the replacement or replenishment time thereof is present, the control circuit 81 outputs a notification drive signal S2 to each of the piezoelectric elements 9 that causes a different vibration frequency to the normal vibration frequency, a different vibration amplitude to the normal vibration amplitude, or a different vibration time to the normal vibration time. For example, in consideration of the fact that vibration amplitude of the piezoelectric elements 9 changes in accordance with the magnitude of voltage applied thereto, the voltage adjustment section 82 may change the magnitude of voltage of a drive signal output to the piezoelectric elements 9 to a different magnitude than that of the normal drive signal S1.

The piezoelectric elements 9 have a resonance frequency at which greatest vibration occurs. The control circuit 81 may cause frequencies of the normal drive signal S1 and the notification drive signal S2 output to the piezoelectric elements 9 to differ from one another by adjusting the lengths of ON periods and OFF periods for voltage application to the piezoelectric elements 9 (i.e., by adjusting a switching frequency of the switching section 83). Also, the control circuit 81 may cause the normal drive signal S1 and the notification drive signal S2 to differ from one another in terms of the length of time that pulses are output to the piezoelectric elements 9, and may thereby cause different vibration times of the piezoelectric elements 9 with respect to the normal drive signal S1 and the notification drive signal S2.

Through the above configuration, the vibration control section 8 can control the vibration amplitude, vibration frequency, or vibration time of the piezoelectric elements 9 and the touch panel section 12 by outputting different drive signals to the piezoelectric elements 9 in the form of the normal drive signal S1 and the notification drive signal S2.

Maintenance Target Units

Figure 6:
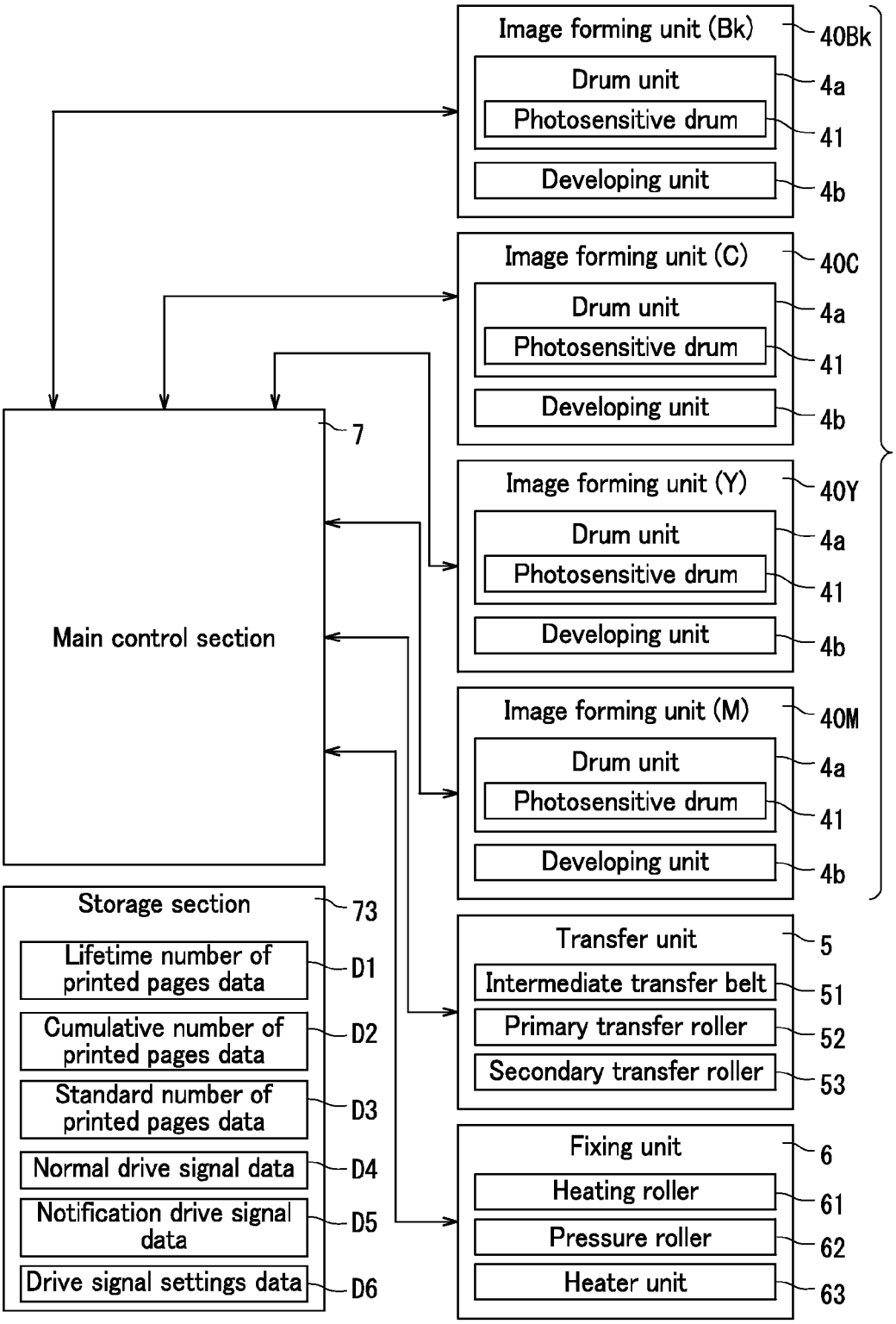
FIG. 6 illustrates units that are maintenance targets.

The following explains units that are maintenance targets with reference to FIGS. 1 and 6. FIG. 6 is provided in order to facilitate explanation of units that are maintenance targets. Note that the image forming units 40 of the respective colors each have the same configuration.

In the multifunction peripheral 100 according to the present embodiment, units related to printing include a plurality of units that are replaceable. The units differ from one another in terms of lifetime and the units can be individually replaced once the lifetime thereof has been reached. Such replacement of units enables extension of the overall lifetime of the multifunction peripheral 100. Examples of units that can be replaced in the multifunction peripheral 100 according to the present embodiment include drum units 4*a*, developing units 4*b*, the transfer unit 5, and the fixing unit 6. Each of the aforementioned units is a maintenance target.

Each of the drum units 4*a* is included in the image forming unit 40 for a corresponding color. The drum unit 4*a* includes a photosensitive drum 41. The photosensitive drum 41 has a surface on which an electrostatic latent image is formed. The photosensitive drum 41 acts as a carrier for a toner image formed through development of the electrostatic latent image using toner. The drum unit 4*a* also includes a gear train that causes rotation of the photosensitive drum 41 and a casing that supports the photosensitive drum 41.

Each of the developing units 4*b* is included in the image forming unit 40 for a corresponding color. A developing unit 4*b* is provided for each toner color such that there are four developing units 4*b* in total. Each of the developing units 4*b* supplies toner to the corresponding photosensitive drum 41, thereby using the toner to develop an electrostatic latent image on the circumferential surface of the photosensitive drum 41. The developing unit 4*b* for example includes a member that carries toner, a member that stirs toner contained in the developing unit 4*b*, and gear trains that causes rotation of various rotatable members.

The transfer unit 5 includes an intermediate transfer belt 51 and a primary transfer roller 52. The transfer unit 5 causes rotation of the intermediate transfer belt 51, applies voltage to the primary transfer roller 52, and causes primary transfer onto the intermediate transfer belt 51 of respective toner images formed on the photosensitive drums 41 such that the toner images are superposed on one another. The transfer unit 5 also includes a secondary transfer roller 53. The transfer unit 5 applies voltage to the secondary transfer roller 53 and causes secondary transfer onto paper of the toner images on the intermediate transfer belt 51. The transfer unit 5 also for example includes a frame that supports the above elements and gear trains that cause rotation of various rotatable members.

The fixing unit 6 includes a heating roller 61 that heats toner and a pressure roller 62 that is pressed against the heating roller 61 such as to form a nip therebetween. The fixing unit 6 causes paper to pass through the nip between the heating roller 61 and the pressure roller 62, thereby fixing a toner image to the paper. The fixing unit 6 also includes a heater unit 63 for heating the heating roller 61. The heater unit 63 for example includes a heater, an ON/OFF switch, a temperature sensor, and an excessive temperature rise prevention circuit. The fixing unit 6 also includes a frame that supports the above elements and gear trains that cause rotation of various rotatable members.

Each of the units (the drum units 4*a*, the developing units 4*b*, the transfer unit 5, and the fixing unit 6) has a preset lifetime number of printed pages indicating a maximum number of pages that the unit can be used to print. The lifetime number of printed pages of each of the units determines the maintenance time (i.e., replacement time) of the unit. The lifetime number of printed pages of each of the units is appropriately determined in consideration of factors such as image quality and degree of abrasion. For example, the lifetime number of printed pages of the drum units 4*a* and the transfer unit 5 is set as 500,000 pages and the lifetime number of printed pages of the developing units 4*b* and the fixing unit 6 is set as 250,000 pages. Lifetime number of printed pages data D1 that indicates the determined lifetime number of printed pages of each of the units is stored in the storage section 73.

The main control section 7 causes the storage section 73 to also store cumulative number of printed pages data D2 therein that indicates, for each of the units, the cumulative number of pages that have been printed since use of the unit began (i.e., since the unit was installed). The main control section 7 for example updates data indicating the cumulative number of printed pages for a unit each time the unit is used to print a page. For example, when black and white printing is performed, the drum unit 4*a* and the developing unit 4*b* for black are used but the drum units 4*a* and the developing units 4*b* for colors other than black are not used. In such a situation, values for the cumulative number of printed pages are only increased for the drum unit 4*a* and the developing unit 4*b* for black. In another example of configuration, the main control section 7 may increase the cumulative number of printed pages for each unit used in printing each time a job is completed by increasing values for the cumulative number of printed pages by the number of pages that are printed during the job.

The main control section 7 determines whether inspection targets are present among the units based on the lifetime number of printed pages data D1 and the cumulative number of printed pages data D2. Each inspection target is a unit that has almost reached the lifetime thereof and thus has almost reached a replacement time thereof. More specifically, the main control section 7 for example determines that a unit is an inspection target when a number of pages obtained by subtracting the cumulative number of printed pages for the unit from the lifetime number of printed pages for the unit is less than a preset standard number of pages. The standard number of pages can be set as appropriate. For example, the standard number of pages may be set as a specific number of pages such as 2,000. In another example, the standard number of pages may be set individually for each of the units by multiplying the lifetime number of printed pages for the unit by a specific percentage such as 5%. The storage section 73 stores standard number of pages data D3 therein that indicates the standard number of pages for each of the units.

The main control section 7 for example recognizes that a unit has been replaced and recognizes the replaced unit through input with respect to the operation panel 1 by a service technician who has replaced the unit. In such a situation, the operation panel 1 receives input indicating that the unit has been replaced. In response, the main control section 7 resets the cumulative number of printed pages for the unit that has been replaced.

Also, in a situation in which an inspection target is present among the units, the main control section 7 causes the display section 11 to display a message indicating that a replacement time of a unit that is the inspection target has almost been reached. The display section 11 displays the message in a preset region such as the bottom left corner or the bottom right corner.

Specific Examples of Maintenance Targets

Figure 7:
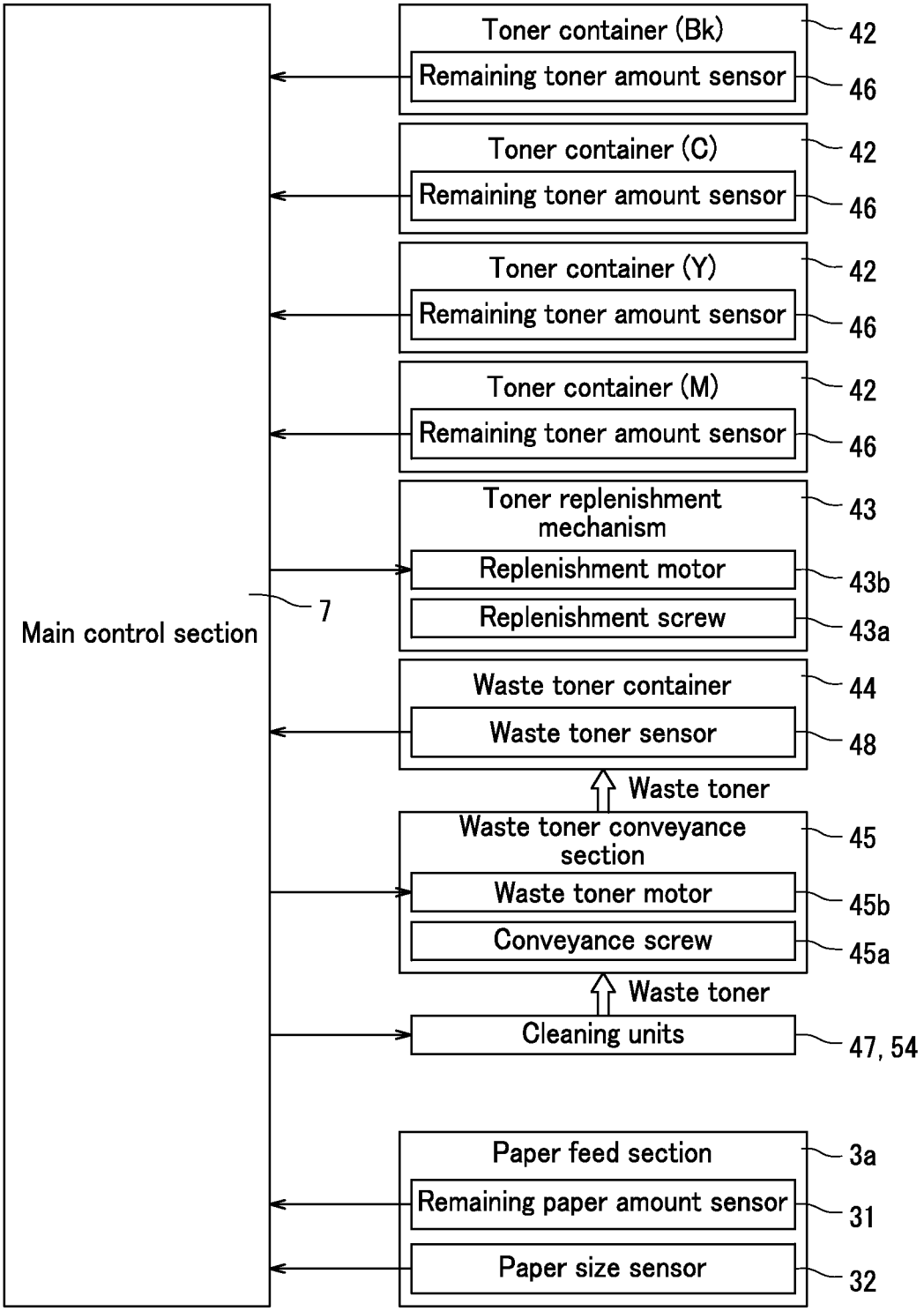
FIG. 7 illustrates toner-related maintenance and paper-related maintenance.

Maintenance related to toner and maintenance related to paper are explained below with reference to FIGS. 1 and 7. FIG. 7 illustrates toner-related maintenance and paper-related maintenance. Note that toner containers 42 and a waste toner container 44 are omitted in FIG. 1 in order to facilitate illustration.

The main control section 7 determines whether or not a time at which toner-related maintenance or paper-related maintenance is to be performed has almost been reached. Toner-related components of the multifunction peripheral 100 include the toner containers 42, a toner replenishment mechanism 43, the waste toner container 44, and a waste toner conveyance section 45. Among the elements listed above, the toner containers 42 and the waste toner container 44 are maintenance targets. The paper feed section 3*a*, which is a component of the multifunction peripheral 100 that supplies paper, is also a maintenance target.

With regards to toner, a toner container 42 is provided for the developing unit 4*b* of each color (i.e., four toner containers 42 are provided in total). Each of the toner containers 42 contains toner of the same color as the toner image that is formed by the corresponding developing unit 4*b* (i.e., one of black, cyan, yellow, and magenta). Each of the toner containers 42 replenishes toner in the corresponding developing unit 4*b*. The toner replenishment mechanism 43 is provided in order to supply toner from the toner containers 42 to the developing units 4*b*. The toner replenishment mechanism 43 includes a replenishment screw 43*a* that conveys toner toward the developing units 4*b* and a replenishment motor 43*b* that causes rotation of the replenishment screw 43*a*. The main control section 7 replenishes toner through rotation of the replenishment motor 43*b* and the replenishment screw 43*a*.

Each of the toner containers 42 has a remaining toner amount sensor 46 therein that detects the remaining amount of toner in the toner container 42. The main control section 7 recognizes the remaining amount of toner in each of the toner containers 42 based on output of the remaining toner amount sensors 46. Note that each of the remaining toner amount sensors 46 is a sensor that is selected in consideration of the properties of toner that is used and can for example be an optical sensor, a magnetic sensor, or a pressure sensor. The main control section 7 may alternatively count a cumulative number of dots onto which toner is supplied with respect to document image data from a time at which the toner container 42 is installed and estimate a remaining amount of toner based on the cumulative number of dots.

Based on the remaining amounts of toner in the toner containers 42 that are recognized by the main control section 7, the main control section 7 determines whether or not the toner containers 42 include a toner container 42 (inspection target) that only has a small remaining amount of toner and thus has almost reached a maintenance time (i.e., replacement time) thereof. More specifically, based on output of the remaining toner amount sensors 46, the main control section 7 determines that a toner container 42 containing less remaining toner than a preset remaining toner amount is an inspection target. For example, the main control section 7 determines that a toner container 42 having a remaining amount of toner of less than 10% is an inspection target.

Note that alternatively the main control section 7 may count a cumulative number of printed pages from a time as which a toner container 42 is installed and may determine that the toner container 42 is an inspection target once the cumulative number of printed pages is greater than a specific number. In such a configuration, the main control section 7 determines that the toner container 42 has been replaced upon the remaining amount of toner that is detected increasing by at least a specific amount. In another example of configuration, the main control section 7 may determine that a toner container 42 for a certain color has been replaced when input of the color of the toner container 42 is made through the operation panel 1.

A situation may occur in which not all toner on the intermediate transfer belt 51 of the transfer unit 5 and the photosensitive drums 41 is transferred, and thus toner remains thereon. The remaining toner interferes with formation of the next toner image. In consideration of the above, the multifunction peripheral 100 according to the present embodiment includes cleaning units 47 and 54 (refer to FIG. 1) that remove remaining toner from the photosensitive drums 41 and the intermediate transfer belt 51. The main control section 7 causes the waste toner conveyance section 45 to convey the removed toner toward the waste toner container 44 as waste toner. The waste toner conveyance section 45 includes a conveyance screw 45*a* that conveys the waste toner and a waste toner motor 45*b* that causes rotation of the conveyance screw 45*a*. The main control section 7 causes rotation of the waste toner motor 45*b* and the conveyance screw 45*a* for a specific period of time during or after a printing job, thereby causing conveyance of the waste toner toward the waste toner container 44.

The waste toner container 44 has a waste toner sensor 48 therein that detects the amount of waste toner in the waste toner container 44. The waste toner sensor 48 detects whether or not the waste toner contained in the waste toner container 44 is greater than a specific amount. As a result of the waste toner container 44 having limited capacity, waste toner may overflow from the waste toner container 44 and contaminate the inside of the apparatus. Therefore, it is necessary to prompt replacement of the waste toner container 44 before waste toner in the waste toner container 44 builds up to a level at which overflowing occurs. The main control section 7 recognizes the amount of waste toner in the waste toner container 44 based on output of the waste toner sensor 48. The waste toner sensor 48 is for example an optical sensor that detects the level of waste toner that has accumulated in the waste toner container 44.

Also, based on output of the waste toner sensor 48 recognized by the main control section 7, the main control section 7 determines that a maintenance time (i.e., a replacement time) for the waste toner container 44 has almost been reached when the amount of waste toner in the waste toner container 44 is greater than a specific amount and thus is almost full.

Note that in the same way as described for the toner containers 42 and each of the units, the main control section 7 may count a cumulative number of printed pages from a time at which the waste toner container 44 is installed and may determine that the waste toner container 44 is an inspection target when the cumulative number of printed pages is greater than a specific number. In such a configuration, the main control section 7 recognizes that the waste toner container 44 has been replaced in response to the amount of waste toner in the waste toner container 44 falling to less than or equal to the aforementioned specific amount. In another example of configuration, the main control section 7 may recognize that the waste toner container 44 has been replaced upon input being made that indicates that the waste toner container 44 has been replaced.

The following explains paper-related maintenance. The paper feed section 3*a* stores paper that is used in printing. The paper feed section 3*a* for example stores approximately 500 sheets of paper. Note that thousands of sheets of paper can be stored in a configuration in which a plurality of paper feed sections 3*a* are provided one on top of another. The paper feed section 3*a* has a remaining paper amount sensor 31 therein that detects the remaining amount of paper in the paper feed section 3*a*.

The main control section 7 recognizes the remaining amount of paper in the paper feed section 3*a* (paper feed cassette) based on output of the remaining paper amount sensor 31. The remaining paper amount sensor 31 is a sensor that is capable of recognizing the remaining amount of paper and can for example be a plurality of optical sensors that are arranged in a stacking direction of paper (i.e., a vertical direction).

The main control section 7 determines whether or not a time at which the paper feed section 3*a* preferably undergoes maintenance (i.e., a paper replenishment time) has almost been reached based on the remaining amount of paper that is recognized thereby. More specifically, the main control section 7 determines that the paper feed section 3*a* is an inspection target when recognizing that the remaining amount of paper is less than a preset amount based on output of the remaining paper amount sensor 31. The main control section 7 for example determines that the paper feed section 3*a* is an inspection target when the remaining amount of paper is less than 10%.

When at least one of the paper feed section 3*a*, the toner containers 42, and the waste toner container 44 is an inspection target, the main control section 7 causes the display section 11 to display a message indicating that a replacement time or a paper replenishment time has almost been reached. The display section 11 displays the message in a preset region such as the bottom left corner or the bottom right corner.

Vibration Process when Inspection Target not Present

Figure 8:
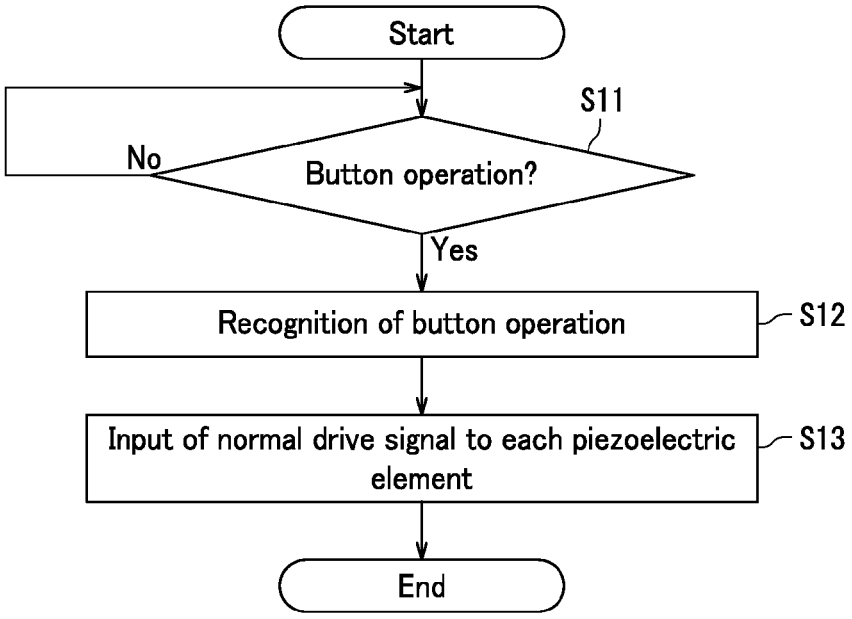
FIG. 8 is a flowchart illustrating an example of a vibration process in a situation in which no inspection target is present.

The following explains the flow of a vibration process in a situation in which no inspection target is present with reference to FIG. 8. FIG. 8 is a flowchart illustrating an example of the vibration process in a situation in which no inspection target is present.

An initial state in FIG. 8 is a state in which the main control section 7 has determined that none of the maintenance targets—the units (the drum units 4*a*, the developing units 4*b*, the transfer unit 5, and the fixing unit 6), the toner containers 42 for each color, the waste toner container 44, and the paper feed section 3*a*—is an inspection target.

First, the panel control section 10 determines whether or not an operation has been performed with respect to a button displayed on the display section 11 based on output of the touch panel section 12 and data of a displayed screen image (Step S11). The panel control section 10 continues to perform the aforementioned determination until a button is operated (i.e., remains on standby when determining No in Step S11).

Upon determining that a button has been operated (Step S11: Yes), the panel control section 10 notifies the main control section 7 that a button has been operated (Step S12). Upon receiving notification that a button has been operated, the vibration control section 8 outputs the preset normal drive signal S1 to each of the piezoelectric elements 9 (Step S13).

The normal drive signal S1 is a pulse signal. An amplitude of the normal drive signal S1, a frequency of the pulse signal, an output number of pulses, a length of time that the normal drive signal S1 is output, and a length of time between the button being operated and output of the normal drive signal S1 commencing are preset. Data indicating the normal drive signal S1 (normal drive signal data D4) is stored in the storage section 73. The vibration control section 8 outputs a signal indicated by the normal drive signal data D4 to each of the piezoelectric elements 9. As a result, the piezoelectric elements 9 and the touch panel section 12 continuously vibrate at the normal vibration amplitude and the normal vibration frequency for the normal vibration time. The normal drive signal S1 is a signal that provides the user with a clicking sensation. The process subsequently ends and restarts from Step S11 (i.e., the process returns to Step S11 after Step S13).

Vibration Process when Inspection Target Present

Figure 9:
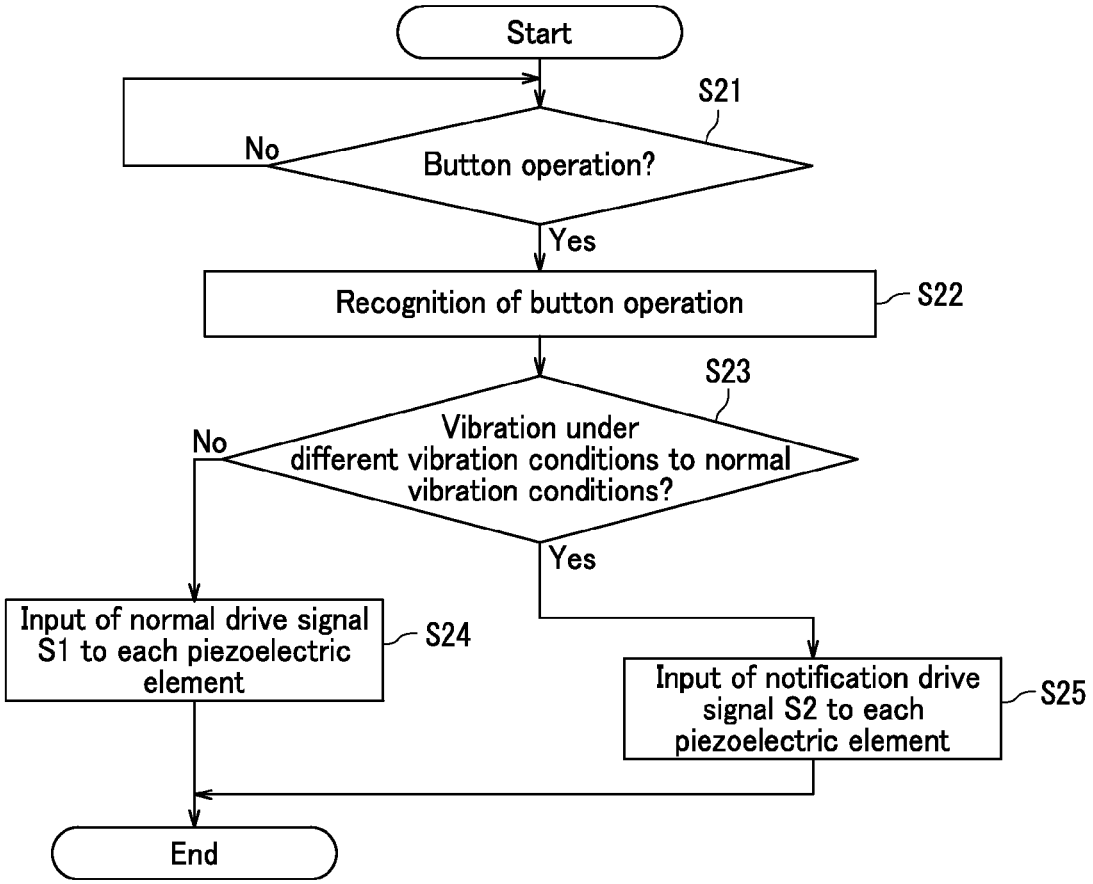
FIG. 9 is a flowchart illustrating an example of a vibration process in a situation in which an inspection target is present.
Figure 10:
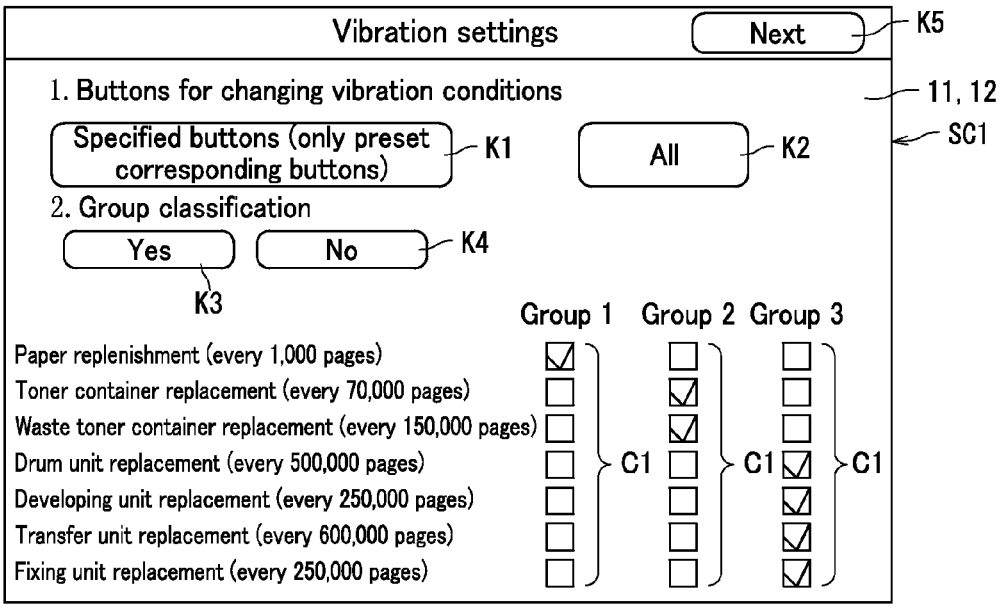
FIG. 10 illustrates an example of a setting screen image for setting different vibration conditions to a normal vibration conditions.
Figure 11:
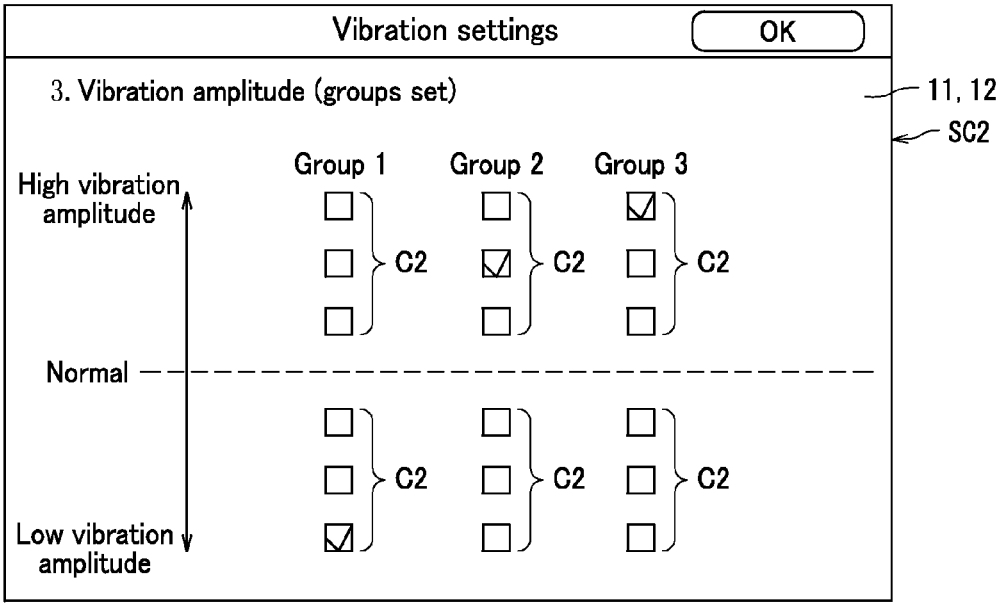
FIG. 11 illustrates an example of a setting screen image for setting different vibration conditions to normal vibration conditions.
Figure 12:
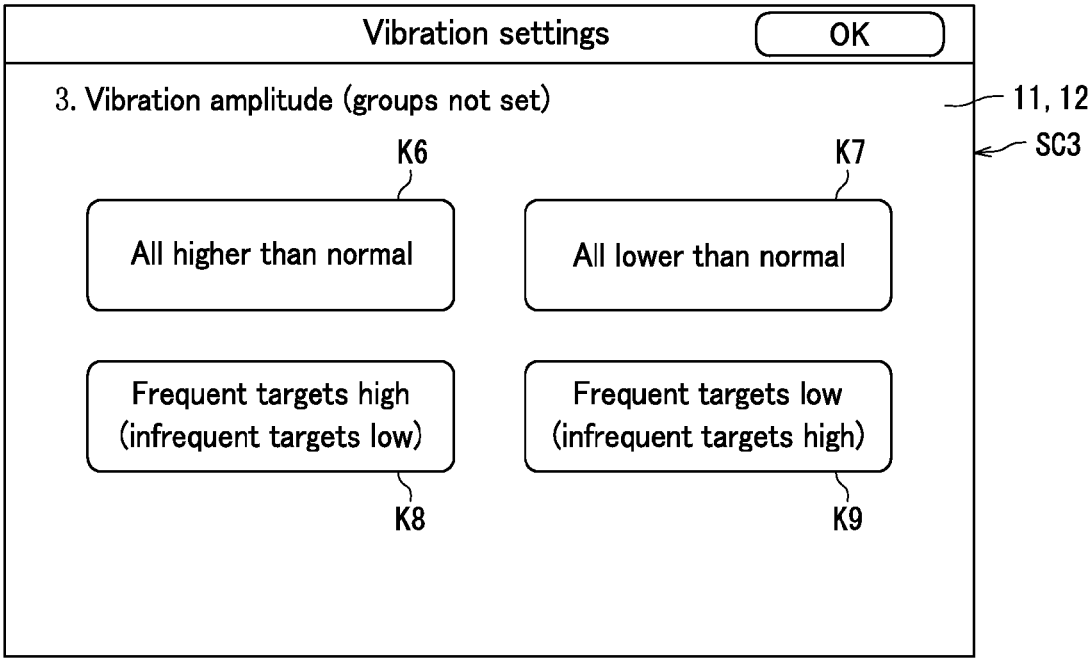
FIG. 12 illustrates an example of a setting screen image for setting different vibration conditions to normal vibration conditions.

The following explains a vibration process in a situation in which an inspection target is present with reference to FIGS. 9-12. FIG. 9 is a flowchart illustrating an example of the vibration process in a situation in which an inspection target is present. FIGS. 10-12 illustrate examples of settings screen images pertaining to vibration for setting different vibration conditions to the normal vibration conditions.

An initial state in FIG. 9 is a state in which the main control section 7 has determined that at least one of the maintenance targets—the units (the drum units 4*a*, the developing units 4*b*, the transfer unit 5, and the fixing unit 6), the toner containers 42 for each color, the waste toner container 44, and the paper feed section 3*a*—is an inspection target. In other words, the initial state is a state in which the main control section 7 has determined that a maintenance target that has almost reached a replenishment or replacement time thereof is present.

First, the panel control section 10 determines whether or not an operation has been performed with respect to a button displayed on the display section 11 based on output of the touch panel section 12 and data of a displayed screen image (Step S21). The panel control section 10 continues to perform the aforementioned determination until a button is operated (i.e., remains on standby when determining No in Step S21).

Upon a button being operated (Step S21: Yes), the panel control section 10 notifies a type of the operated button to the main control section 7 (Step S22). Based on the type of the operated button, the main control section 7 determines whether or not to cause the piezoelectric elements 9 to vibrate under different vibration conditions to the normal vibration conditions (Step S23).

In the multifunction peripheral 100 according to the present embodiment, one or more of the buttons displayed on the display section 11 can be set as buttons for which operation thereof while an inspection target is present results in vibration under different conditions to the normal vibration conditions. FIG. 10 is used to explain the above point.

FIG. 10 is a screen image (first vibration settings screen image SC1) for setting vibration conditions in a situation in which an inspection target is present. The panel control section 10 causes the display section 11 to display the first vibration settings screen image SC1 when a specific operation is performed with respect to the operation panel 1.

Buttons arranged in the first item of the first vibration settings screen image SC1 illustrated in FIG. 10 can be operated in order to set buttons for which operation thereof while an inspection target is present results in vibration of the piezoelectric elements 9 and the touch panel section 12 under different vibration conditions to the normal vibration conditions.

When a first selection button K1 on the left-hand side of the first item in the first vibration settings screen image SC1 illustrated in FIG. 10 is operated, the panel control section 10 determines that a setting has been made for only causing the piezoelectric elements 9 and the touch panel section 12 to vibrate under different vibration conditions to the normal vibration conditions in a situation in which a preset specified button is operated while an inspection target is present.

A specified button can be set appropriately for each maintenance target (inspection target). For example, a button related to paper settings can be set as a specified button for the paper feed section 3*a*. For example, a button for selecting a setting item for paper size used in printing may be set as a specified button for the paper feed section 3*a*. In another example, a button for selecting a paper size (for example, a button including text "A4" or "Letter") in a paper size selection screen image displayed when the setting item for paper size is selected may be set as a specified button for the paper feed section 3*a*. In another example, a button including text corresponding to a size of paper stored in the paper feed section 3*a* (for example, a button including text "A4" in a situation in which A4 size paper is stored in the paper feed section 3*a*) may be set as a specified button for the paper feed section 3*a*. The paper feed section 3*a* may have a paper size sensor 32 therein that detects the size of paper stored in the paper feed section 3*a* (refer to FIG. 7). The main control section 7 recognizes the size of paper stored in the paper feed section 3*a* based on output of the paper size sensor 32. In the above configuration in which a button related to paper settings is set as a specified button for the paper feed section 3*a*, the user can be notified that the paper feed section 3*a* or another paper-related maintenance target is an inspection target by considering the type of button that is operated directly prior to vibration occurring under different vibration conditions to the normal vibration conditions.

Also, a button related to color settings and a button related to toner can be set as specified buttons for the toner containers 42 and the waste toner container 44. For example, a button for selecting a color settings item for printed matter and a button for displaying a screen image indicating the remaining amount of toner in each of the toner containers 42 may be set as specified buttons for the toner containers 42 and the waste toner container 44. In another example, a button for setting the color of printed matter (i.e., color or monochrome) may be set as a specified button for the toner containers 42 and the waste toner container 44. In another example, a button indicating the color of a toner container 42 that is an inspection target (for example, when a black toner container 42 is an inspection target, a button that is black in color or that includes text "Black") may be set as a specified button for the toner containers 42 and the waste toner container 44. In the above configuration in which toner-related buttons are set as specified buttons for the toner containers 42 and the waste toner container 44, the user can be notified that the toner containers 42 and the waste toner container 44 are inspection targets by considering the type of button that has been operated directly prior to vibration occurring under different vibration conditions to the normal vibration conditions.

A button related to image quality settings or for adjusting printed image quality can be set as a specified button for each of the units (the drum units 4*a*, the developing units 4*b*, the transfer unit 5, and the fixing unit 6). For example, a button for setting printing density may be set as a specified button for each of the units. Also, a button related to a refresh process performed through an abrasive agent contained in toner that is caused to adhere to the photosensitive drums 41 may be set as a specified button for the drum units 4*a*. A button for adjusting voltage applied to the developing units 4*b* may be set as a specified button for the developing units 4*b*. Also, a button related to a calibration process of transferring a toner image onto the intermediate transfer belt 51 in order to check displacement and color shift may be set as a specified button for the transfer unit 5. Also, a button related to temperature settings of the heating roller 61 during printing may be set as a specified button for the fixing unit 6. As described above, buttons related to a printing process or to adjustment of the printing process can be set as specified buttons for each of the units. Also, the user can be notified of a unit that is an inspection target by considering the type of button that is operated directly prior to vibration occurring under different vibration conditions to the normal vibration conditions.

On the other hand, the following process is performed when a second selection button K2 on the right-hand side of the first item of the first vibration settings screen image SC1 illustrated in FIG. 10 is operated. The panel control section 10 determines that a setting has been made to cause the piezoelectric elements 9 and the touch panel section 12 to vibrate under different vibration conditions to the normal vibration conditions in a situation in which any button displayed on the display section 11 is operated while an inspection target is present.

Returning to explanation of FIG. 9, the main control section 7 determines whether or not to cause vibration under different vibration conditions to the normal vibration conditions based on whether all buttons or only a specified button is set and based on the operated button (Step S23). In a situation in which a setting has been made for vibration under different conditions to the normal vibration conditions only upon operation of a specified button, the main control section 7 determines to cause vibration under the different vibration conditions if the operated button is a specified button for a current inspection target (Step S23: Yes). On the other hand, if the operated button is not a specified button for a current inspection target, the main control section 7 determines to cause vibration under the normal vibration conditions (Step S23: No). In a situation in which a setting has been made for vibration of the piezoelectric elements 9 and the touch panel section 12 under different vibration conditions to the normal vibration conditions upon operation of any button, the main control section 7 determines to cause vibration under the different vibration conditions (Step S23: Yes).

Upon determining to cause vibration under the normal vibration conditions (Step S23: No), the main control section 7 causes the vibration control section 8 to output the preset normal drive signal S1 to each of the piezoelectric elements 9 (Step S24). The process subsequently ends and restarts from Step S21 (i.e., returns to Step S21 after Step S24).

Upon determining to cause vibration under different vibration conditions to the normal vibration conditions (Step S23: No), the main control section 7 causes the vibration control section 8 to output the notification drive signal S2, differing to the normal drive signal S1, to each of the piezoelectric elements 9 (Step S25). The process subsequently ends and restarts from Step S21 (i.e., the process returns to Step S21 after Step S25).

The multifunction peripheral 100 according to the present embodiment enables setting of vibration conditions that are caused when the notification drive signal S2 is output to the piezoelectric elements 9 (i.e., for when vibration conditions are different to normal). FIGS. 10-12 are used to explain the above point.

The multifunction peripheral 100 according to the present embodiment enables classification of a plurality of maintenance targets into groups. Upon an operation being performed with respect to a Yes button K3 in the first vibration settings screen image SC1 illustrated in FIG. 10, the panel control section 10 determines that a setting has been made to classify the maintenance targets into groups.

A plurality of maintenance targets are displayed arranged in a vertical direction below the Yes button K3. Check boxes C1 are provided in order to set a group to which each of the maintenance targets belongs. In the multifunction peripheral 100 according to the present embodiment, three check boxes C1 are provided for each of the maintenance targets. Therefore, the maintenance targets can be classified into three groups. Through the above configuration, the touch panel section 12 receives input classifying the maintenance targets into groups and the panel control section 10 recognizes which group each of the maintenance targets belongs to based on output of the touch panel section 12.

In the example illustrated in FIG. 10, paper replenishment (paper feed section 3*a*) which has the highest frequency of becoming an inspection target (i.e., frequency of replacement or replenishment) is set as belonging to Group 1. The toner containers 42 and the waste toner container 44 which each have a medium frequency of becoming an inspection target (i.e., frequency of replacement or replenishment) are set as belonging to Group 2. The units (the drum units 4*a*, the developing units 4*b*, the transfer unit 5, and the fixing unit 6) which each have a low frequency of becoming an inspection target (i.e., frequency of replacement or replenishment) are set as belonging to Group 3.

When a Next button K5 in the first vibration settings screen image SC1 is operated while group classification is set, the panel control section 10 causes the display section 11 to display a second vibration settings screen image SC2 illustrated in FIG. 11. A vibration amplitude can be set for each of the groups by checking check boxes C2 arranged in the second vibration settings screen image SC2. Although an example is illustrated in which vibration amplitude can be increased or decreased in the second vibration settings screen image SC2 by up to three levels (i.e., six levels in total) relative to the normal amplitude, alternatively a large number of levels may be selectable.

Notification drive signal data D5 indicating a notification drive signal S2 for each of the levels is stored in the storage section 73. The main control section 7 causes the vibration control section 8 to output a notification drive signal S2 to the piezoelectric elements 9 based on the notification drive signal data D5 stored in the storage section 73 and the levels set in the second vibration settings screen image SC2.

The vibration control section 8 may cause different vibration conditions through the notification drive signal S2 and the normal drive signal S1 by only changing amplitudes thereof. In such a situation, the vibration control section 8 causes the amplitude of the normal drive signal S1 and the amplitude of the notification drive signal S2 to differ from one another.

Alternatively, the vibration control section 8 may cause different vibration conditions through the notification drive signal S2 and the normal drive signal S1 by only changing pulse signal frequencies thereof. In such a situation, the vibration control section 8 causes the frequency of the normal drive signal S1 and the frequency of the notification drive signal S2 to differ from one another. The vibration control section 8 outputs a notification drive signal S2 to the piezoelectric elements 9 having a frequency in accordance with the vibration amplitude level that is set such that the higher the vibration amplitude level, the closer the frequency of the notification drive signal S2 is to a characteristic vibration frequency of the piezoelectric elements 9.

Alternatively, the vibration control section 8 may cause different vibration conditions through the notification drive signal S2 and the normal drive signal S1 by only changing the pulse signal output times thereof. In such a situation, the vibration control section 8 causes a length of time over which the normal drive signal S1 is output and a length of time over which the notification drive signal S2 is output to differ from one another.

Alternatively, the notification drive signal S2 and the normal drive signal S1 may be caused to differ from one another in terms of any combination of amplitude, frequency, and continuous signal output time.

In the second vibration settings screen image SC2 illustrated in FIG. 11, the lowest vibration amplitude level is set for Group 1 which has the highest frequency of becoming an inspection target (i.e., frequency of replacement or replenishment). Also, the highest vibration amplitude level is set for Group 3 which has the lowest frequency of becoming an inspection target. Furthermore, a vibration amplitude level that is lower than for Group 3 but higher than for the normal drive signal S1 is set for Group 2 which has a medium frequency of becoming an inspection target. Thus, vibration amplitude has a relationship: Group 1<Group 2<Group 3.

In another example, a high vibration amplitude level may conversely be set for Group 1 which has the highest frequency of becoming an inspection target. In another example, a vibration amplitude level that is higher than the normal vibration amplitude may be set for each of the groups or a vibration amplitude level that is lower than the normal amplitude may be set for each of the groups. As described above, the panel control section 10 receives settings for classifying a plurality of maintenance targets into groups. Also, the vibration control section 8 outputs a different notification drive signal S2 for each group and thus causes a different vibration amplitude for each group. Note that the same vibration amplitude level may be set for two different groups or for all of the groups.

Also, in the multifunction peripheral 100 according to the present embodiment, a notification drive signal S2 for when an inspection target is present can be set without classifying the maintenance targets into groups. More specifically, upon an operation being performed with respect to a No button K4 in the first vibration settings screen image SC1 illustrated in FIG. 10, the panel control section 10 determines that a setting has been made to not classify the maintenance targets into groups.

Upon operation of the Next button K5 in the first vibration settings screen image SC1 in a situation in which a setting not to perform group classification has been made, the panel control section 10 causes the display section 11 to display a third vibration settings screen image SC3 illustrated in FIG. 12. In the third vibration settings screen image SC3 there are four different options that can be selected with respect to vibration amplitude when an inspection target is present.

The following first explains a process that is performed when an increased vibration button K6 is operated, which is a top left button among four buttons arranged in the middle of the screen image. The panel control section 10 determines that a setting has been made to, in a situation in which a notification drive signal S2 is output to the piezoelectric elements 9 in order to cause a different vibration amplitude to the normal vibration amplitude, cause a higher vibration amplitude than the normal vibration amplitude regardless of the type of inspection target that is present. Therefore, when such a setting is made, the main control section 7 causes the vibration control section 8 to output a notification drive signal S2 to the piezoelectric elements 9 that causes a higher vibration amplitude than the normal vibration amplitude regardless of the type of inspection target that is present.

The following explains a process that is performed when a suppressed vibration button K7 is operated, which is a top right button among the four buttons arranged in the middle of the screen image. The panel control section 10 determines that a setting has been made to, in a situation in which a notification drive signal S2 is output to the piezoelectric elements 9 in order to cause a different vibration amplitude to the normal vibration amplitude, cause a lower vibration amplitude than the normal vibration amplitude regardless of the type of inspection target that is present. Therefore, when such a setting is made, the main control section 7 causes the vibration control section 8 to output a notification drive signal S2 to the piezoelectric elements 9 that causes a lower vibration amplitude than the normal vibration amplitude regardless of the type of inspection target that is present.

The following explains a process that is performed when a frequent target increase button K8 is operated, which is a bottom left button among the four buttons arranged in the middle of the screen image. The panel control section 10 determines that a setting has been made to, in a situation in which a notification drive signal S2 is output to the piezoelectric elements 9 in order to cause a different vibration amplitude to the normal vibration amplitude, cause a higher vibration amplitude than the normal vibration amplitude when a maintenance target preset as a frequent target is an inspection target. Also, the panel control section 10 determines to cause a lower vibration amplitude than the normal vibration amplitude when a maintenance target preset as an infrequent target is an inspection target. Therefore when such a setting is made, the main control section 7 causes the vibration control section 8 to output a notification drive signal S2 to the piezoelectric elements 9 that causes either a higher or lower vibration amplitude than the normal vibration amplitude depending on the inspection target that is present.

The following explains a process that is performed when a frequent target suppression button K9 is operated, which is a bottom right button among the four buttons arranged in the middle of the screen image. The panel control section 10 determines that a setting has been made to, in a situation in which a notification drive signal S2 is output to the piezoelectric elements 9 in order to cause a different vibration amplitude to the normal vibration amplitude, cause a lower vibration amplitude than the normal vibration amplitude when a maintenance target preset as a frequent target is an inspection target. Also, the panel control section 10 determines to cause a higher vibration amplitude than the normal vibration amplitude when a maintenance target preset as an infrequent target is an inspection target. Therefore, when such a setting is made, the main control section 7 causes the vibration control section 8 to output a notification drive signal S2 to the piezoelectric elements 9 that causes either a higher or lower vibration amplitude than the normal vibration amplitude depending on the inspection target that is present.

Each of the maintenance targets may be set as appropriate as being a frequent target or an infrequent target. For example, the paper feed section 3*a*, the toner containers 42, and the waste toner container 44 may be preset as frequent targets and each of the units (the drum units 4*a*, the developing units 4*b*, the transfer unit 5, and the fixing unit 6) may be set as an infrequent target.

The operation panel 1 receives a setting of whether or not to classify the maintenance targets into groups, a setting of which groups to classify the maintenance targets into when classification is performed, and a setting of vibration amplitude for each of the groups. Content of the aforementioned settings is stored in the storage section 73 as drive signal settings data D6 (refer to FIG. 3). Also, when classification into groups is not performed, the operation panel 1 receives a setting of which button among the increased vibration button K6, the suppressed vibration button K7, the frequent target increase button K8, and the frequent target suppress button K9 is selected. Content of the aforementioned setting is stored in the storage section 73 as drive signal settings data D6 (refer to FIG. 3). The main control section 7 causes the vibration control section 8 to output signals to the piezoelectric elements 9 in accordance with the drive signal settings data D6.

As explained above, the image forming apparatus (multifunction peripheral 100) according to the embodiment includes the operation panel 1 that includes the display section 11, the touch panel section 12, the plurality of piezoelectric elements 9, and the panel control section 10. The display section 11 displays buttons on a screen for operation. The touch panel section 12 is located with respect to the display section 11 such as to receive an operation from a user by detecting a position that is touched. The piezoelectric elements 9 are arranged in contact with the touch panel section 12. The panel control section 10 recognizes content of the operation from the user based on output of the touch panel section 12. The multifunction peripheral 100 further includes the vibration control section 8 and the main control section 7. The vibration control section 8 outputs a drive signal to the piezoelectric elements 9 that causes vibration of the touch panel section 12. The main control section 7 determines for each maintenance target (the drum units 4*a*, the developing units 4*b*, the transfer unit 5, the fixing unit 6, the toner containers 42, the waste toner container 44, and the paper feed section 3*a*) that is target for replacement or replenishment and that has a maintenance time preset in accordance with a type thereof, whether or not the maintenance target is an inspection target that preferably undergoes maintenance within a preset period of a current time, based on the maintenance time of the maintenance target. In a situation in which a button is operated while no inspection target is present, the vibration control section 8 causes the touch panel section 12 and the piezoelectric elements 9 to vibrate under normal vibration conditions by outputting the preset normal drive signal S1 to the piezoelectric elements 9. In a situation in which a specified button is operated while at least one inspection target is present, the vibration control section 8 causes the touch panel section 12 and the piezoelectric elements 9 to vibrate under different vibration conditions to the normal vibration conditions by outputting the notification drive signal S2 to the piezoelectric elements 9.

Through the above configuration, different vibration to normal can be caused to occur when a button is operated while an inspection target is present; the inspection target is a maintenance target that has almost reached a time at which the maintenance target preferably undergoes maintenance.

The difference of the caused vibration compared to normal vibration attracts the attention of the user and notifies the user through sense of touch that there is a maintenance target that should preferably be inspected.

Different vibration conditions may be caused to occur by outputting a notification drive signal S2 to the piezoelectric elements 9 that differs from the normal drive signal S1 in terms of at least one of voltage (amplitude), frequency, and length of drive signal output time to the piezoelectric elements 9.

Also, in a situation in which the determination section (main control section 7) determines that an inspection target is present, upon a specified button preset as a button corresponding to the inspection target being operated, the vibration control section 8 outputs the notification drive signal S2 to the piezoelectric elements 9. Also, the vibration control section 8 may output the normal drive signal S1 to the piezoelectric elements 9 upon a button that is not the specified button being operated. Through the above configuration, the piezoelectric elements 9 and the touch panel section 12 can be caused to vibrate under different vibration conditions to the normal vibration conditions upon a specified button corresponding to an inspection target being operated. Therefore, the user can be notified through sense of touch that a maintenance target related to the specified button should preferably be replaced or replenished. Also, the user can be notified as to which maintenance target should preferably be replaced or replenished.

Also, in a situation in which the determination section (main control section 7) determines that an inspection target is present, the vibration control section 8 may output the notification drive signal S2 to the piezoelectric elements 9 upon any of the buttons displayed on the display section 11 being operated. In the above configuration, the user can be notified through sense of touch that a maintenance target that should preferably be inspected is present as a result of different vibration to normal being caused upon operation of any button.

The notification drive signal S2 is a drive signal that causes a higher or lower vibration amplitude when output to the piezoelectric elements 9 by the vibration control section 8 than when the normal drive signal S1 is output to the piezoelectric elements 9. In the above configuration, the user can be notified through sense of touch that a maintenance target that should preferably be inspected is present as a result of the difference in vibration amplitude.

The plurality of maintenance targets (the drum units 4*a*, the developing units 4*b*, the transfer unit 5, the fixing unit 6, the toner containers 42, the waste toner container 44, and the paper feed section 3*a*) may be classified into groups and the vibration control section 8 may output a different notification drive signal S2 for each of the groups. In the above configuration, the user can to a certain extent narrow down a search for which maintenance target should preferably be inspected based on the vibration conditions experience thereby due to different vibration conditions being caused to occur in response to operation of different buttons in terms of group units. The user should preferably inspect maintenance targets belonging to a group corresponding to the vibration conditions experienced by the user.

The maintenance targets include the paper feed section 3*a* that stores paper for printing therein and that includes the remaining paper amount sensor 31 which detects a remaining amount of stored paper. The determination section (main control section 7) determines that the paper feed section 3*a* is an inspection target when recognizing that the remaining amount of stored paper is less than a preset remaining paper amount based on output of the remaining paper amount sensor 31. In the above configuration, the user can be notified through sense of touch that the remaining amount of paper is small and that a time has almost been reached at which paper will run out, and thus that paper should preferably be replenished.

The maintenance targets include the toner containers 42 that store toner for replenishment use and the waste toner container 44 that stores waste toner produced as a result of printing. The image forming apparatus (multifunction peripheral 100) includes the remaining toner amount sensors 46, the waste toner conveyance section 45, and the waste toner sensor 48. Each of the remaining toner amount sensors 46 detects the remaining amount of toner stored in the corresponding toner container 42. The waste toner conveyance section 45 conveys waste toner created as a result of printing to the waste toner container 44. The waste toner sensor 48 detects whether or not the waste toner contained in the waste toner container 44 is greater than a specific amount. The determination section (main control section 7) determines that a toner container 42 is an inspection target when recognizing based on output of the remaining toner amount sensor 46 that the remaining amount of toner stored in the toner container 42 is less than a preset remaining toner amount. The determination section (main control section 7) determines that the waste toner container 44 is an inspection target when recognizing based on output of the waste toner sensor 48 that the amount of waste toner contained in the waste toner container 44 is greater than the specific amount. In the above configuration, the user can be notified through sense of touch that the toner containers 42 have run out of toner and thus hayed reached a replacement time thereof, and also that the waste toner container 44 is almost full and thus has almost reached a replacement time thereof.

The image forming apparatus (multifunction peripheral 100) also includes the storage section 73 that stores a number of printed pages therein indicating the number of pages that have been printed. The maintenance targets include at least unit among the drum units 4*a*, the transfer unit 5, the developing units 4*b*, and the fixing unit 6. Each of the drum units 4*a* includes a photosensitive drum 41 used for printing. The transfer unit 5 transfers a toner image onto paper. Each of the developing unit 4*b* develops an electrostatic latent image on the corresponding photosensitive drum 41 using toner. The fixing unit 6 fixes a toner image transferred onto paper. The determination section (main control section 7) causes the storage section 73 to store a cumulative number of printed pages for each of the units from a time at which the unit was installed to the current time. The determination section (main control section 7) determines that a unit is an inspection target when a number of pages obtained by subtracting the cumulative number of printed pages from a lifetime number of printed pages that is preset for the unit is less than a preset number of pages. In the above configuration, the user can be notified through sense of touch that a unit has almost reached the lifetime thereof and thus that the replacement time of the unit has been reached.

When the determination section (main control section 7) determines that an inspection target is present, the determination section causes the display section 11 to display maintenance information pertaining to the inspection target. In the above configuration, the user can be notified specific information pertaining to the inspection target. The display section 11 displays message information when an inspection target is present (for example, a message indicating that a replacement time or a paper replenishment time has almost been reached). A message displayed in a preset region of the display section 11 such as bottom left corner or a bottom right corner can be brought to the user's attention by causing different vibration to normal when a button is operated.

The image forming apparatus (multifunction peripheral 100) includes the display input device (operation panel 1) described above. Therefore, the touch panel section 12 can be easily, accurately, and intuitively set to vibrate at a vibration amplitude desired by a user when a button is operated. As a result, the user can be provided with an ideal clicking sensation and an image forming apparatus (multifunction peripheral 100) can be provided that enables user friendly settings and input operation by a user.

In terms of setting specified buttons for the maintenance targets, an example was explained in which a button related to paper settings is set as a specified button for the paper feed section 3*a*, but a button for selecting paper size may be set individually for each maintenance target. More specifically, in a situation in which the remaining amount of A4 size paper is less than a preset remaining paper amount, vibration under different vibration conditions to the normal vibration conditions may be caused when the user attempts to use A4 size paper by operating a button for selecting A4 size paper displayed in a paper size selection screen image.

Although the present disclosure is explained through the above embodiment, the scope of the present disclosure is of course not limited to the embodiment and various alterations may be adopted in implementation so long as such alterations do not deviate from the essence of the present disclosure.

For example, although an example was explained in which the vibration control section 8 is included in the main control section 7 of the multifunction peripheral 100, the vibration control section 8 may be included in the operation panel 1 or the panel control section 10.

What is claimed is:

1. An image forming apparatus comprising:

an operation panel including a display section configured to display buttons on a screen for receiving operations from a user, a touch panel section configured to receive an operation from the user by detecting a position at which a touch is performed with respect to the display section, a plurality of piezoelectric elements arranged in contact with the touch panel section, and a panel control section configured to detect content of the operation from the user based on output of the touch panel section;

a vibration control section configured to output a drive signal to the piezoelectric elements that causes vibration of the piezoelectric elements and the touch panel section;

one or more maintenance targets that are each a target for replacement or replenishment and that each have a maintenance time that is preset in accordance with a type thereof;

a determination section that determines for each of the maintenance targets based on the maintenance time thereof, whether or not the maintenance target is an inspection target that preferably undergoes maintenance within a preset period of a current time, wherein the vibration control section:

upon operation of a button displayed by the display section while no inspection target is present, causes the touch panel and the piezoelectric elements to vibrate under a normal vibration condition by outputting a preset normal drive signal to the piezoelectric elements; and upon operation of a preset button displayed by the display section while the inspection target is present, causes the touch panel and the piezoelectric elements to vibrate under a different vibration condition to the normal vibration condition by outputting a notification drive signal to the piezoelectric elements that is different to the normal drive signal.

2. The image forming apparatus according to claim 1, wherein in a situation in which the determination section determines that at least one of the maintenance targets is the inspection target, the vibration control section:

outputs the notification drive signal to the piezoelectric elements upon operation of a specified button that is preset as corresponding to the inspection target determined by the determination section; and outputs the normal drive signal to the piezoelectric elements upon operation of a button other than the specified button.

3. The image forming apparatus according to claim 1, wherein in a situation in which the determination section determines that at least one of the maintenance targets is the inspection target, the vibration control section outputs the notification drive signal to the piezoelectric elements upon operation of any of the buttons displayed by the display section.

4. The image forming apparatus according to claim 1, wherein the notification drive signal causes a vibration amplitude of the piezoelectric elements when output thereto that differs from a vibration amplitude of the piezoelectric elements when the normal drive signal is output thereto.

5. The image forming apparatus according to claim 1, wherein the one or more maintenance targets are classified into groups, and the vibration control section outputs a different notification drive signal for each of the groups.

6. The image forming apparatus according to claim 1, wherein the one or more maintenance targets include a paper feed section that stores paper used in printing, the paper feed section includes a remaining paper amount sensor that detects a remaining amount of paper stored in the paper feed section, the determination section determines whether or not the remaining amount of paper stored in the paper feed section is less than a preset remaining paper amount based on output of the remaining paper amount sensor, and the determination section determines that the paper feed section is the inspection target when determining that the remaining amount of paper is less than the preset remaining paper amount.

7. The image forming apparatus according to claim 1, wherein the one or more maintenance targets include a toner container that stores toner for replenishment use and a waste toner container that stores waste toner produced during printing, the image forming apparatus further comprises:

a remaining toner amount sensor configured to detect a remaining amount of toner stored in the toner container;

a waste toner conveyance section configured to convey the waste toner produced during printing to the waste toner container; and a waste toner sensor configured to detect whether or not an amount of waste toner stored in the waste toner container is greater than a specific amount, and the determination section:

determines whether the remaining amount of toner stored in the toner container is less than a preset remaining toner amount based on output of the remaining toner amount sensor;

determines that the toner container is the inspection target when determining that the remaining amount of toner is less than the preset remaining toner amount;

determines whether or not the amount of waste toner stored in the waste toner container is greater than the specific amount based on output of the waste toner sensor; and determines that the waste toner container is the inspection target when determining that the amount of waste toner is greater than the specific amount.

8. The image forming apparatus according to claim 1, further comprising a storage section configured to store a number of printed pages indicating the number of pages that have been printed, wherein the one or more maintenance targets include one or more units among a drum unit including a photosensitive drum used during printing, a developing unit that develops an electrostatic latent image on a photosensitive drum, a transfer unit that transfers a toner image onto paper, and a fixing unit that fixes a toner image transferred onto paper, the determination section:

causes the storage section to store a cumulative number of printed pages for each of the units from a time at which the unit is installed until the current time and determines for each of the units whether or not a number of pages resulting from subtracting the cumulative number of printed pages from a lifetime number of printed pages preset for the unit is less than a preset number of pages, and determines that the unit is the inspection target when determining that the resulting number of pages is less than the preset number of pages.

9. The image forming apparatus according to claim 1, wherein in a situation in which the determination section determines that at least one of the maintenance targets is the inspection target, the determination section causes the display section to display maintenance information pertaining to the inspection target.

10. The image forming apparatus according to claim 1, wherein the one or more maintenance targets include a toner container that stores toner for replenishment use and a waste toner container that stores waste toner produced during printing, the image forming apparatus further comprises:

a waste toner conveyance section configured to convey the waste toner produced during printing to the waste toner container; and a remaining toner amount sensor configured to detect a remaining amount of toner stored in the toner container, and the determination section:

determines whether or not the remaining amount of toner stored in the toner container is less than a preset remaining toner amount based on output of the remaining toner amount sensor; and determines that the toner container is the inspection target when determining that the remaining amount of toner is less than the preset remaining toner amount.

11. The image forming apparatus according to claim 1, wherein the one or more maintenance targets include a waste toner container that stores waste toner produced during printing, the image forming apparatus further comprises:

a waste toner conveyance section configured to convey the waste toner produced during printing to the waste toner container; and a waste toner sensor configured to detect whether or not an amount of waste toner stored in the waste toner container is greater than a specific amount, and the determination section:

determines whether or not the amount of waste toner stored in the waste toner container is greater than the specific amount based on output of the waste toner sensor; and determines that the waste toner container is the inspection target when determining that the amount of waste toner is greater than the specific amount.

12. The image forming apparatus according to claim 1, wherein the different vibration condition differs from the normal vibration condition in terms of at least one of vibration amplitude, vibration frequency, and continuous vibration time.

* * * * *